US008151873B1

(12) United States Patent
Lee et al.

(10) Patent No.: US 8,151,873 B1
(45) Date of Patent: Apr. 10, 2012

(54) EXPANDABLE PACKER WITH MANDREL UNDERCUTS AND SEALING BOOST FEATURE

(75) Inventors: Chee K Lee, Cypress, TX (US); Mark K. Adam, Houston, TX (US); Jeffrey C. Williams, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/034,408

(22) Filed: Feb. 24, 2011

(51) Int. Cl.
*E21B 23/00* (2006.01)

(52) U.S. Cl. ..... 166/134; 166/387; 166/118; 166/179; 166/202; 166/138

(58) Field of Classification Search ..... 166/179, 166/118, 202, 134, 138
See application file for complete search history.

(56) References Cited

U.S. PATENT DOCUMENTS

| | | | |
|---|---|---|---|
| 6,959,759 | B2 | 11/2005 | Doane et al. |
| 6,986,390 | B2 | 1/2006 | Doane et al. |
| 7,051,805 | B2 | 5/2006 | Doane et al. |
| 7,387,158 | B2 | 6/2008 | Murray et al. |
| 7,392,841 | B2 | 7/2008 | Murray et al. |
| 7,431,078 | B2 | 10/2008 | Carmody et al. |
| 7,441,596 | B2 | 10/2008 | Wood et al. |
| 7,478,679 | B2 | 1/2009 | Berzin et al. |
| 7,493,945 | B2 | 2/2009 | Doane et al. |
| 7,552,768 | B2 | 6/2009 | O'Brien |
| 7,562,704 | B2 | 7/2009 | Wood et al. |
| 7,661,471 | B2 | 2/2010 | Murray et al. |
| 7,661,473 | B2 | 2/2010 | Garcia |
| 7,681,653 | B2 | 3/2010 | Korte et al. |
| 7,730,940 | B2 | 6/2010 | Knippa et al. |
| 2005/0000697 | A1 | 1/2005 | Abercrombie Simpson et al. |
| 2009/0277648 | A1* | 11/2009 | Nutley et al. ..... 166/382 |
| 2009/0308592 | A1* | 12/2009 | Mercer et al. ..... 166/134 |
| 2010/0314130 | A1 | 12/2010 | Durst et al. |

OTHER PUBLICATIONS

Durst, D.G., "Integrating Solid Expandables, Swellables, and Hydra Jet Perforating for Optimized Multizone Fractured Wellbores", SPE 125345, Jun. 2009, 1-10.

* cited by examiner

*Primary Examiner* — William P Neuder
*Assistant Examiner* — Yong-suk Ro
(74) *Attorney, Agent, or Firm* — Steve Rosenblatt

(57) ABSTRACT

An open hole packer uses mandrel expansion and a surrounding sealing element that can optionally have a swelling feature and further a seal enhancing feature of a ring with an internal taper to match an undercut on the mandrel exterior. As a swage progresses to the taper at the transition between the ring and the extending flat fingers, the fingers get plastically deformed in an outward radial direction to push out the sealing element. Shrinkage of the mandrel axially due to radial expansion brings a ring on the mandrel outer surface under the fingers to act as a support for the fingers against the seal which is pushed against the open hole. Mirror image orientations are envisioned to aid in retaining pressure differentials in opposed directions. Another external mandrel ring extends into the seal to keep its position during differential pressure loading.

20 Claims, 5 Drawing Sheets

EXPANDABLE PACKER WITH MANDREL UNDERCUTS AND SEALING BOOST FEATURE

FIELD OF THE INVENTION

The field of the invention is expandable open hole packers and more particularly those that use the expansion process for increasing sealing contact pressure and using applied pressure differential to enhance the sealing force.

BACKGROUND OF THE INVENTION

Packers are mounted on tubular strings and have to pass through close clearances in existing tubulars to get to the location where the packer is to be deployed. In some cases the dimensional difference between the drift diameter of the existing tubular that the packer needs to pass and the set dimension is so great as to create problems in getting a reliable seal. The limits of the tubular in expansion can be reached in situations where the mandrel is expanded. Some examples of packers set by expansion can be seen in U.S. Pat. Nos. 6,959,759; 6,986,390; 7,051,805 and 7,493,945.

Some designs rely on the element to swell in the presence of well fluids such as water or hydrocarbons, such as: 7387158; 7478679; 7730940; 7681653; 7552768; 7441596; 7562704; 7661471. In some of these designs the reduction in stiffness and resulting contact pressure is offset with applied axial compressive forces triggered with the swelling as shown in U.S. Pat. No. 7,552,768 or thereafter as a result of pressure differentials such as U.S. Pat. No. 7,392,841. Swelling to make a seal is a time consuming process which can mean significant additional operator cost if the swelling has to conclude to a sealing condition before other steps can be undertaken in a well completion.

Some designs rely on axial mandrel shrinkage to apply an axial boost force to ends of a sealing element that is being radially expanded as illustrated in U.S. Pat. No. 7,431,078.

Other designs involved the use of packer cups that could be run through another tubular and then spring outwardly in the larger wellbore to obtain a seal. These designs suffered from potential damage during run in that could destroy their ability to seal. Their inherent design limited the speed that they could be run into or removed from a wellbore without swabbing the well coming out or pressurizing the formation on the trip into the well.

Some designs used tubular expansion combined with exterior rings that moved relatively to each other to extend the reach of a packer in the wellbore as illustrated in U.S. Pat. No. 7,661,473. This design also had an option for using a swelling material 44 as the sealing element. The expansion enhancing mechanism went the length of the seal element and due to the ramp structure it employed to enlarge wound up adding to the initial dimension while providing only a limited amount of enhancement in the radial direction to the underlying mechanical expansion of the mandrel.

US Publication 20050000697 illustrates a technique of corrugating pipe downhole to make it more flexible for subsequent expansion. US Publication 2010 0314130 illustrates using internal spacers and driving a swage through them to expand a seal into a wellbore wall.

What is needed and provided by the present invention, among other features, is the ability to parlay the expansion force of the mandrel into a rotational movement of fingers attached to a ring. The fingers bend outwardly to move the sealing element toward a wellbore wall to enhance the sealing contact. The fingers can bend independently so as to make the pushing out of the seal conform to a surrounding borehole wall that is not necessarily round and can be oval or irregular. The mandrel features an external ring that due to shrinkage of the mandrel as it is expanded winds up under the bent fingers to further hold out the fingers against the sealing element to maintain the seal. The ring and finger structure permits fluid to get under an end of the sealing element and to further aid in pushing the element against the borehole wall which can be open hole. Another ring from the mandrel exterior extends into the element to retain it against sliding force from pressure differentials. Various options are possible such as orienting the rings with fingers in mirror image orientations to enhance seal against differential pressures from above or below the set seal. The ring itself can be an extrusion barrier and as another option the seal can extend the length of the fingers and their base ring. Those skilled in the art will better appreciate the various aspects of the present invention from a review of the description of the preferred embodiment and the associated drawings while recognizing that the full scope of the invention is to be determined from the appended claims.

SUMMARY OF THE INVENTION

An open hole packer uses mandrel expansion and a surrounding sealing element that can optionally have a swelling feature and further a seal enhancing feature of a ring with an internal taper to match an undercut on the mandrel exterior. As a swage progresses to the taper at the transition between the ring and the extending flat fingers, the fingers get plastically deformed in an outward radial direction to push out the sealing element. Shrinkage of the mandrel axially due to radial expansion brings a ring on the mandrel outer surface under the fingers to act as a support for the fingers against the seal which is pushed against the open hole. Mirror image orientations are envisioned to aid in retaining pressure differentials in opposed directions. Another external mandrel ring extends into the seal to keep its position during differential pressure loading.

DETAILED DESCRIPTION OF THE PREFERRED EMBODIMENT

Figure 1:
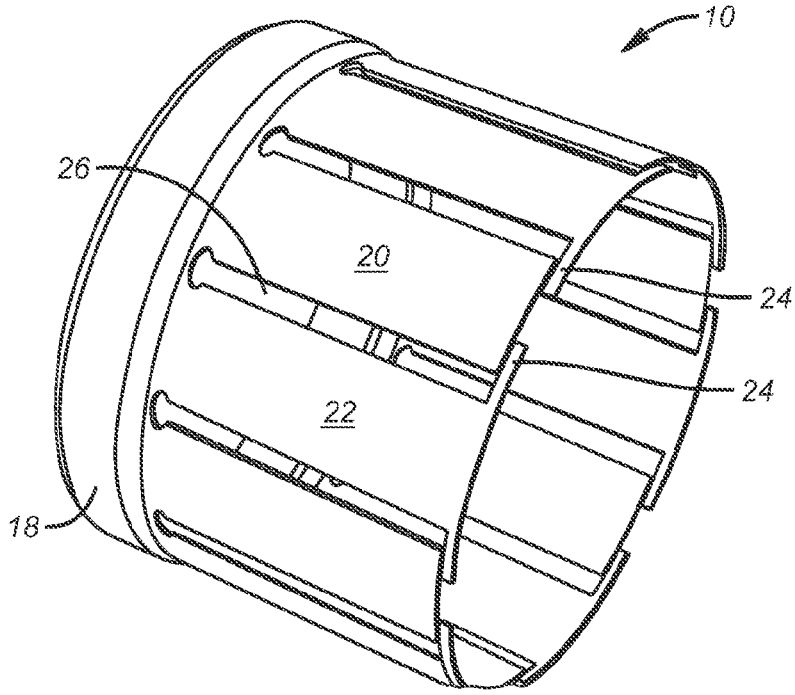
FIG. 1 is a perspective view of the finger ring in the supporting position after expansion of the mandrel.
Figure 2:
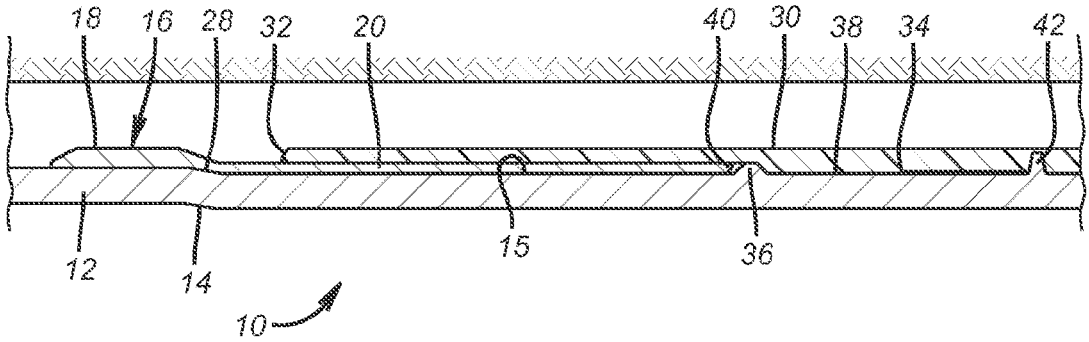
FIG. 2 is a section view of the run in position of the packer.

FIG. 2 shows the elements of the packer assembly 10 in one embodiment. A mandrel 12 has a taper 14 that forms an undercut 15 on the outer surface of the mandrel 12. The support ring 16 is an assembly that has an initially split ring 18 that allows the assembly 16 to be slipped over the mandrel 12 and positioned as shown whereupon the ring 18 can be welded back into a cohesive circular shape and secured to the mandrel 12. The assembly 16 has alternating fingers 20 and 22 that are best seen in FIG. 1. Fingers 22 have end components 24 that span over gaps 26 that have rounded lower ends 29 to dissipate stress that accumulates at the transition between the ring 18 and the fingers 20 and 22. There is a tapered transition 28 between the ring 18 and the fingers 20 and 22. The sealing element 30 in this embodiment overlays the fingers 20 and 22 at end 32. Location 34 represents the end of the boding between the sealing element 30 and the mandrel 12. A circumferential ring 36 extends from the outer surface 38 of the mandrel 12 and inside the undercut 15. In the run in position the ring 36 is spaced from lower end 40 of the fingers 20 and 22. Radial expansion of the mandrel 12 will cause mandrel 12 to shrink longitudinally and bring the ring 36 under the ends 40 of fingers 20 and 22. The fingers 22 at their respective ends 24 will initially be contacted by ring 36 as the mandrel 12 shrinks axially from radial expansion from within. Another ring 42 extends from outer surface 38 in the undercut 15 and into the seal 30. This ring 42 is more for fixation of the seal 30 in the set position with applied pressure differentials and also has some benefit in stopping fluid leak paths between the seal 30 and the outer surface 38 of the mandrel 12. While a single illustrative ring 36 or 42 are illustrated additional rings or even other shapes or segmented rings can be used.

The drift dimension of ring 18 is at least as large as the sealing element 30 for run in to provide protection to the sealing element 30

Figure 3:
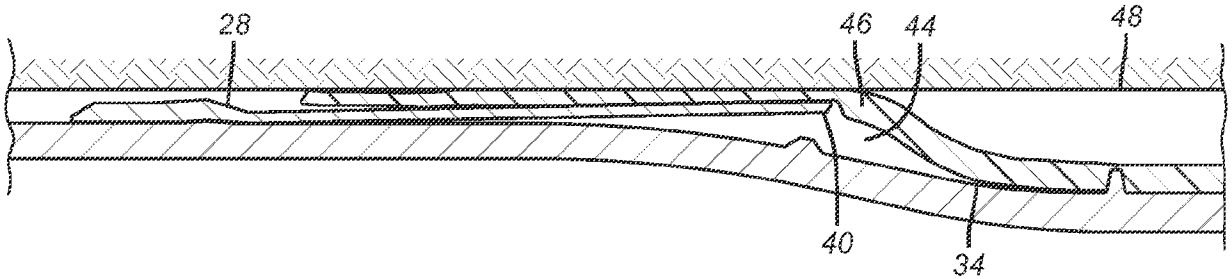
FIG. 3 is the view of FIG. 2 after expansion has started.

FIG. 3 compared with FIG. 2 illustrates what happens as the swage advances and the taper 14 that defines the undercut 15 is progressively removed. What happens is that the fingers 20 and 22 are plastically deformed at the transition 28 so that the cantilevered fingers 20 and 22 have their free ends 40 come away from the mandrel 12 to define a temporary gap 44 between the mandrel 12 and the ends 40 that has the effect of creating a hump in the sealing element 30 as the ends 40 that have been plastically deformed now push a hump 46 created in the sealing element 30 against the borehole wall 48. Some fingers 20 or 22 move further than others depending on the shape of the open hole where the packer assembly 10 is being expanded. It should also be noted in FIG. 3 that the ring 36 has moved axially due to mandrel shrinkage from expansion so that it is now under the fingers 20 and 22. Location 34 illustrates where the bonding of the seal 30 to the mandrel 12 stops in a more dramatic form. It should be noted that when expanding the mandrel 12 that the ring 18 can either be expanded or not to get the effect described above.

Figure 4:
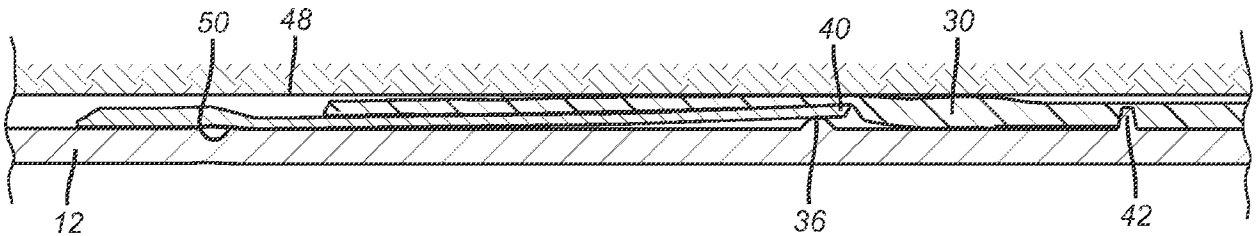
FIG. 4 is the view of FIG. 3 at the conclusion of expansion and before differential pressure loading.
Figure 7:
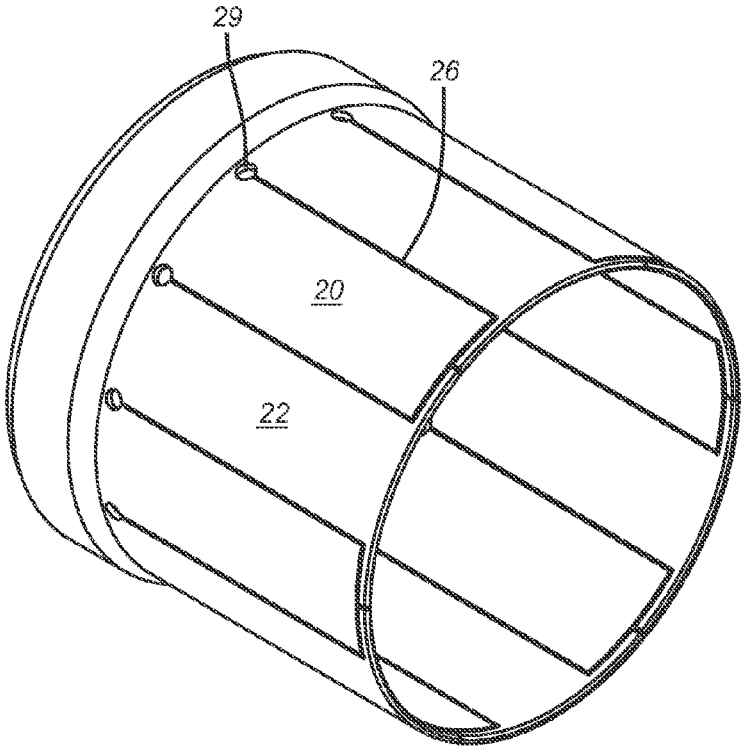
FIG. 7 is a perspective view of the exterior of the finger ring in the run in position.

FIG. 4 shows the expansion completed and no applied differential pressure. The undercut 15 is eliminated. The underside 50 of the ring 18 no longer has a taper as in the FIG. 2 position. The mandrel 12 has shrunk placing ring 36 under the fingers 20 and 22 to the left of the ends 40. Ends 40 are cantilevered into the sealing element 30 pinching it against the open hole wellbore wall 48. The gaps 26 between fingers 20 and 22 have enlarged due to the expansion as can be seen by comparing FIG. 7 for the run in and FIG. 1 for the expanded state. Ring 42 is pushed further into the sealing element 30 to retain it against axial movement in response to applied differential pressure and also to enhance the ability to resist leak paths that can start between the sealing element 30 and the outer surface 38 of the mandrel 12. By this time in the expansion the fingers 20 and 22 have been initially plastically deformed urging ends 40 against the seal element 30 until the seal element 30 is against the borehole wall, followed by the mandrel 12 then raising the ring 36 back into contact with the now plastically bent fingers 20 and 22 have bent about the axis at the taper 28. The expansion has increased the diameter of the mandrel 12 and added to that increase is the height of the ring 36 and the thickness of the finger 20 or 22 all of which now support the sealing element 30 into the borehole wall 48.

Figure 5:
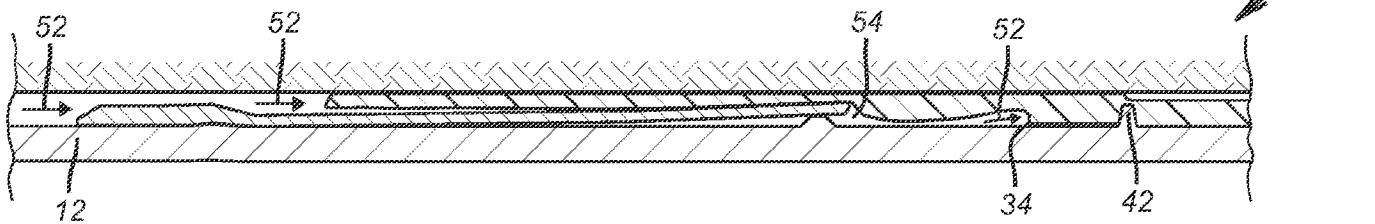
FIG. 5 is the view of FIG. 4 with a pressure differential applied from above.

As can be seen in FIG. 5 arrows 52 pressure differential from above goes through the slots 26 that are seen in FIG. 1 and goes all the way back to location 34 where the bonding to the mandrel 12 stops. In essence a long pocket 54 is formed at an end of the sealing element 30 so that in resisting pressure differential from uphole the end of the sealing element 30 takes on the characteristics of an upwardly facing packer cup against differential from uphole represented by arrow 52. It should be noted that issues of damage on delivery that packer cups typically have are avoided because for the run in position of FIG. 2 the sealing element 30 is retracted into the undercut 15 and further protected by ring 18 that sticks out radially at least as far as the sealing element 30. Ring 42 keeps the sealing element 30 from shifting under the load represented by arrow 52. Also shown in FIG. 6 is end 40' portion of a finger such as 20' or 22' of a mirror image assembly 10'.

The support ring 18 can be initially split so that it can be fit over the mandrel 12 and axially fixated by having a groove 19 that fits over a key 21. The location of the key and the groove can be reversed. When there is differential pressure as indicated by arrow 52 is will more likely communicate past ring 18 in any clearance gap after expansion around ring 18 and within tubular wall 48.

Figure 6:
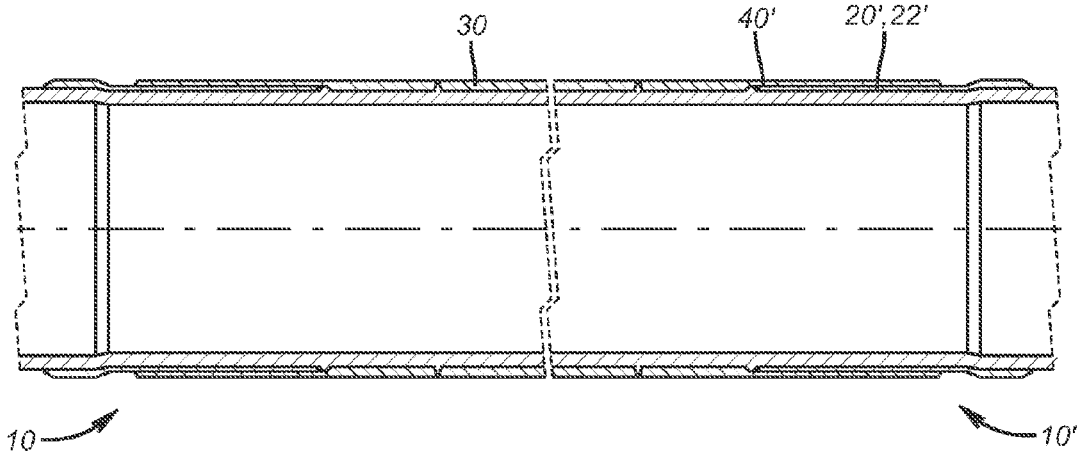
FIG. 6 shows a mirror image arrangement to boost the sealing force against differentials from opposed directions.

FIG. 6 shows two assemblies 10 and 10' in mirror image orientations. In this view they are shown in the run in position but in the set position with a differential in the direction of arrow 52 in FIG. 5 or in the opposite direction to arrow 52 one of the illustrated ends exhibits the shape of the sealing element 30 that is shown in FIG. 5 but the orientation is opposite hand depending on the direction of the pressure differential. In essence the behavior is akin to opposed packer cups with the upper one pointing uphole and the lower one pointing downhole. Although the sealing element 30 is shown to be continuous over the fingers 20 and 22 and 20' and 22' of the opposed assemblies and any gaps in between, those skilled in the art will appreciate that the sealing element 30 can also be in segments and optionally the segments can extend to ends 40 or 40' of the illustrated assemblies 10 or 10', as more clearly illustrated in FIGS. 8 and 9.

Figure 8:
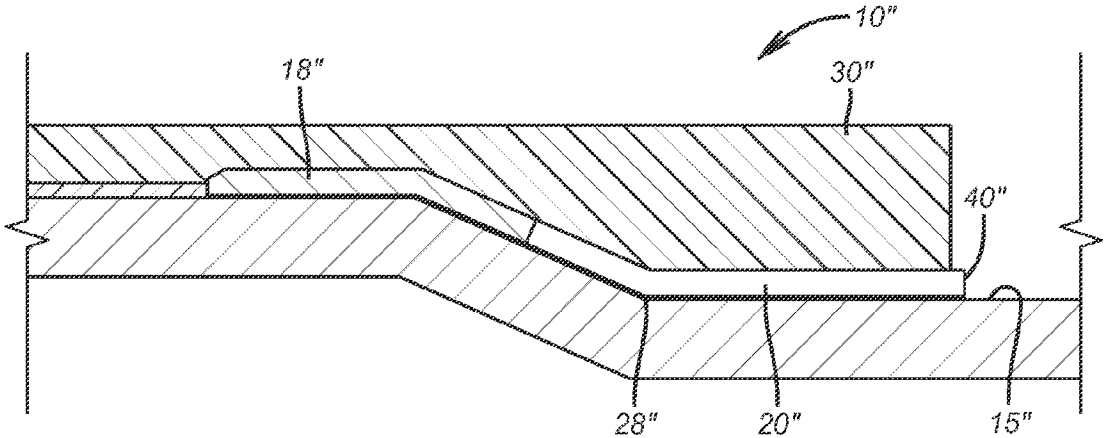
FIG. 8 is an alternative embodiment to FIG. 2 shown in the run in position.
Figure 9:
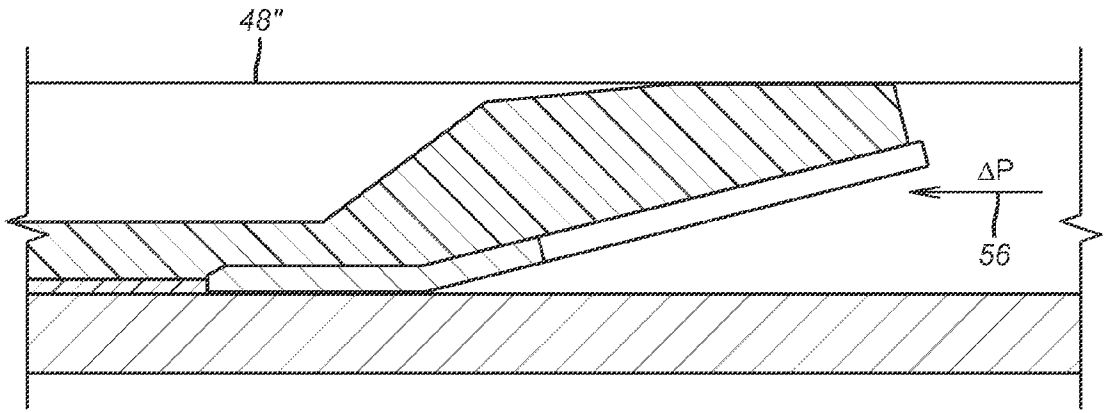
FIG. 9 is the view of FIG. 8 in the set position with differential pressure from below.
Figure 10:
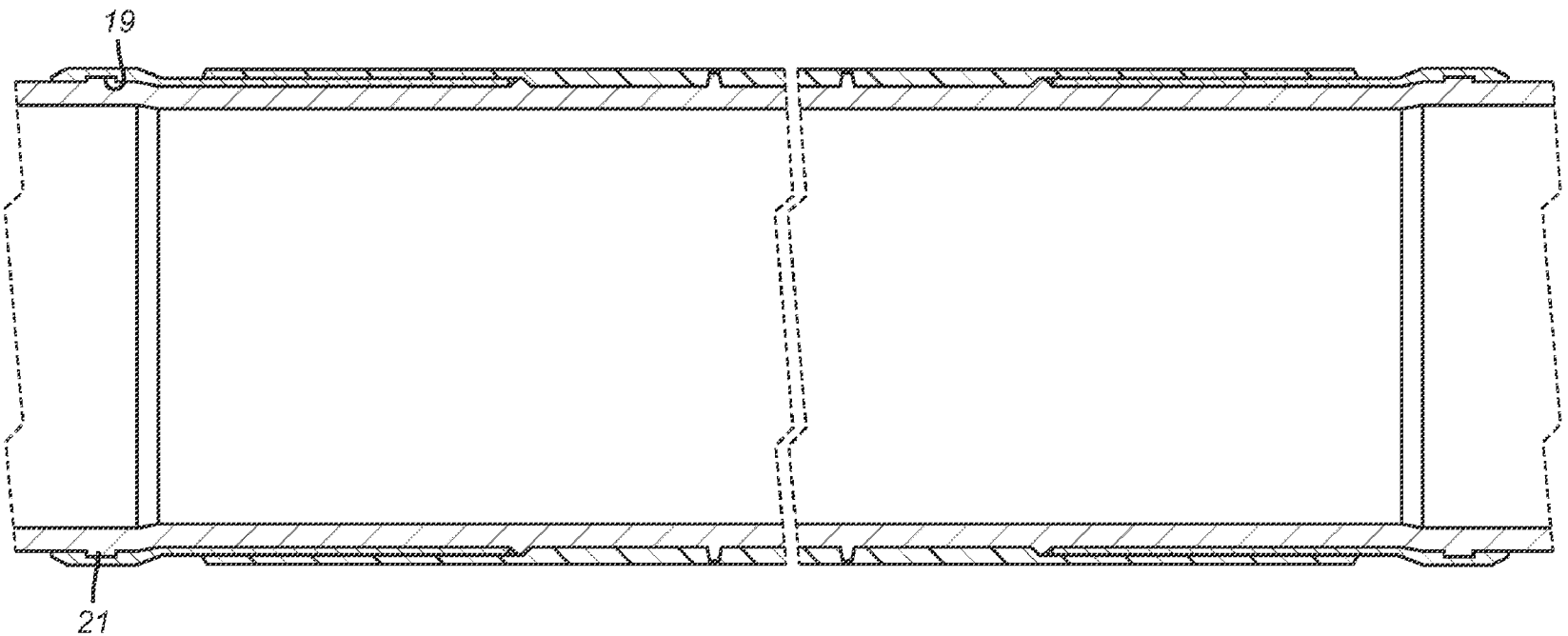
FIG. 10 is an alternate view of FIG. 6 showing the fixation keyway.

FIG. 8 is the run in position of assembly 10" that has fingers 20" and 22" as described previously except that the sealing element 30" stops near or at end 40". In this version, the ring 18" is covered by the sealing element 30" and the ring 18" is covered over with the sealing element 30" such that the ring 18" can function as a type of extrusion barrier or at minimum as a stabilizer ring to prevent axial shifting of the sealing element 30". The response during expansion of the mandrel 12" is as described before. The undercut 15" is removed and the fingers 20" and 22" are plastically bent near transition 28" so that the sealing element 30" engages the borehole wall 48". In the illustrated embodiment differential pressure loading in the direction of arrow 56 makes the assembly behave similarly to an extended packer cup. Additional assemblies can be aligned in the same direction as backup or in mirror image orientation to be able to energize with differentials in opposed directions. Those skilled in the art will also realize that in the FIG. 6 embodiment can have a single assembly in a given orientation or multiples in the same orientation.

What is shown is an assembly that has a low protected profile for run in due to the sealing element being retracted and in an undercut and protected by a ring structure with extending fingers that define gaps between them. The gaps are closed at the cantilevered ends as alternating fingers overlap ends of adjacent fingers. The tapered transition in the ring and finger structure makes the fingers turn out in plastic deformation against a surrounding sealing element to hold the sealing element out against the borehole wall. Such support can be enhanced with a ring that positions itself under the fingers to hold their ends out against the sealing element. The seal enhancing assemblies when mounted on the ends of a sealing element also allow well fluids to reach the underside at the ends of the sealing element. In situations where such element is a swelling element, the end swelling is enhanced as the actuating fluid such as water or hydrocarbons fully surrounds the end of the sealing element for enhanced swelling and thus sealing. The gaps between the fingers that enlarge during expansion also promote such fluid exposure not only to enhance swelling but also to enhance the sealing force from pressure delivered between the mandrel and the sealing element to give the sealing element the operating characteristics of a packer cup without the downsides of such seals such as low pressure differential tolerance, damage on run in and swabbing the well on the way out. The illustrated designs allow for a seal to form rapidly without having to delay other procedures waiting for swelling only to make the seal as in previous designs. The boost sealing force occurs from under the sealing element as opposed to axially oriented spring systems as used in the past. The expansion process and configuration of the finger ring creates packer cup like behavior in an annularly shaped element. The use of an undercut allows the sealing element to be protected for run in by the ring of the finger ring assembly. The undercut dovetails with a taper on the transition between the ring and the fingers to create the pivoting plastic deformation of the fingers that presses out the sealing element. The plastic pivoting movement can be further bolstered by a support ring that moves into position due to axial shrinkage that results from expansion especially with the mandrel in compression. Mirror image assemblies are contemplates as well as sealing elements that end at the end of the fingers that can have the support that moves into position due to axial shrinkage during expansion or that support can be optionally omitted. Retention devices can also extend from the mandrel into the sealing element to assist in axial fixation and minimizing of leak paths between the sealing element and the mandrel. The sealing element ends that overlap the fingers are not bonded to the fingers or the mandrel so as to facilitate fluid entry under the sealing element for a boost force. The sealing element can optionally swell to enhance the seal. Multiple assemblies in the same orientation are also envisioned for backup purposes. The entire string that delivers the mandrel does not need to be expanded but rather just the mandrel itself is sufficient for expansion to get the desired sealing benefit of the present invention. Alternatively portions of the delivering string or the entire string can be expanded into the borehole wall with the expandable packer segments. Any tubular joints that are under the sealing element need not still seal after the expansion as the sealing element against the borehole wall will cover such joints.

The above description is illustrative of the preferred embodiment and many modifications may be made by those skilled in the art without departing from the invention whose scope is to be determined from the literal and equivalent scope of the claims below.

We claim:

1. A packer for subterranean use in a borehole defined by a wall, comprising:

an expandable tubular housing;

a sealing element surrounding said housing and engaging the borehole when said housing is expanded;

at least one sealing boost force device on said housing acting on said sealing element between said sealing element and said housing to further urge, independently of the expansion of said housing, said sealing element toward the wall;

said sealing boost force device is located at least in part in an undercut formed by an outer surface of said housing, wherein expansion of said undercut actuates said boost force device.

2. The packer of claim 1 wherein:

a portion of said sealing boost force device is not covered by sealing element and said portion extends radially, before said housing is expanded, at least as far as said sealing element.

3. The packer of claim 1, wherein:

said sealing element extends in part into said undercut before said housing is expanded.

4. The packer of claim 1, wherein:

said undercut is eliminated with expansion of said housing.

5. The packer of claim 1, wherein:

said at least one sealing boost force device further comprising at least one cantilevered member.

6. The packer of claim 5, wherein:

said cantilevered member comprises a plurality of cantilevered fingers extending generally axially from a ring mounted around said housing.

7. The packer of claim 6, wherein:

said fingers defining axially oriented gaps between them;

said fingers have overlapping free ends to close said gaps.

8. The packer of claim 6, wherein:

said fingers connected to said ring through a tapered transition such that expansion of said housing engages said transition to force said fingers to plastically rotate about said transition and toward said sealing element.

9. The packer of claim 8, wherein:

said tapered transition is located adjacent an end of said undercut.

10. The packer of claim 8, wherein:

said fingers plastically rotate with or without expansion of said ring.

11. The packer of claim 6, further comprising:

a support member located between said housing and said sealing element and movable from an initial location at a spaced axial distance from a free end of said fingers to a second location between said free end of said fingers and said ring.

12. The packer of claim 11, further comprising:

said support member moves toward said cantilevered member as a result of longitudinal shrinkage of said housing from radial expansion thereof.

13. The packer of claim 12, further comprising:

said support member located between said housing and said sealing element and movable from an initial location at a spaced axial distance from a free end of said fingers to a second location between said free end of said fingers and said ring.

14. The packer of claim 13, further comprising:

said support member comprises at least one continuous ring or spaced segments on an outer surface of said housing.

15. The packer of claim 13, further comprising:

said sealing element is secured to said housing only to a location spaced apart from said support member;

an end of said sealing member that is not secured to said housing is pushed toward the wall by said sealing boost force device and said sealing boost force device permits pressurized borehole fluid to get between said housing and said sealing element to enhance the boost from said sealing boost force device against the wall.

16. The packer of claim 1, wherein:

said housing further comprises at least one retaining member extending into said sealing member to axially fixate said sealing member to said housing.

17. The packer of claim 1, wherein:

said at least one sealing boost force device comprises opposed sealing boost force devices disposed in mirror image to each other or aligned sealing boost force devices oriented in the same direction.

18. The packer of claim 6, wherein:

said ring is axially restrained to said mandrel.

19. The packer of claim 5, wherein:

said sealing element having an end adjacent a free end of said cantilevered member.

20. A packer for subterranean use in a borehole defined by a wall, comprising:

a tubular housing;

a sealing element surrounding said housing;

at least one sealing boost force device on said housing acting on said sealing element between said sealing element and said housing to urge said sealing element toward the wall;

said sealing boost force device is located at least in part in an undercut formed on an outer surface of said housing;

said at least one sealing boost force device further comprising at least one cantilevered member;

said sealing element having an end adjacent a free end of said cantilevered member;

said sealing element at least wholly covers said sealing boost force device;

expansion of said housing bends said cantilevered member away from said housing to move said sealing element against the wall while leaving a gap for pressurized borehole fluids to get between said housing and said cantilevered member to boost the sealing force against the wall.

* * * * *

UNITED STATES PATENT AND TRADEMARK OFFICE

CERTIFICATE OF CORRECTION

PATENT NO. : 8,151,873 B1
APPLICATION NO. : 13/034408
DATED : April 10, 2012
INVENTOR(S) : Chee K. Yee et al.

It is certified that error appears in the above-identified patent and that said Letters Patent is hereby corrected as shown below:

On the Title page at (75), please delete "Chee K. Lee", and insert therefor -- Chee K. Yee --.

Signed and Sealed this
Sixth Day of November, 2012

David J. Kappos

David J. Kappos
*Director of the United States Patent and Trademark Office*